US009617741B2

(12) United States Patent
Devos

(10) Patent No.: US 9,617,741 B2
(45) Date of Patent: Apr. 11, 2017

(54) SET OF PANELS WITH LOCKING ELEMENT

(71) Applicant: Flooring Industries Limited, SARL, Bertrange (LU)

(72) Inventor: Pieter Devos, Koolskamp (BE)

(73) Assignee: Flooring Industries Limited, SARL, Bertrange (LU)

( * ) Notice: Subject to any disclaimer, the term of this patent is extended or adjusted under 35 U.S.C. 154(b) by 0 days.

(21) Appl. No.: 14/633,973

(22) Filed: Feb. 27, 2015

(65) Prior Publication Data

US 2015/0252573 A1 Sep. 10, 2015

(51) Int. Cl.

| | |
|---|---|
| ***E04B 2/00*** | (2006.01) |
| ***E04F 15/02*** | (2006.01) |
| ***E04C 2/38*** | (2006.01) |

(52) U.S. Cl.

CPC ..... *E04F 15/02038* (2013.01); *E04C 2/38* (2013.01); *E04F 15/02* (2013.01); *E04F 2201/0107* (2013.01); *E04F 2201/0115* (2013.01); *E04F 2201/0138* (2013.01); *E04F 2201/0146* (2013.01); *E04F 2201/0153* (2013.01); *E04F 2201/0169* (2013.01);

(Continued)

(58) Field of Classification Search

None

See application file for complete search history.

(56) References Cited

U.S. PATENT DOCUMENTS 7,621,092 B2 * 11/2009 Groeke ..... E04F 15/02 52/582.1
7,677,005 B2 * 3/2010 Pervan ..... B27F 1/02 52/582.1

(Continued)

FOREIGN PATENT DOCUMENTS

EP 1415056 5/2004
WO WO-94/26999 11/1994

(Continued)

OTHER PUBLICATIONS

European Search Report for Application No. 14 15 8173 dated Nov. 18, 2014.

*Primary Examiner* — Chi Q Nguyen
(74) *Attorney, Agent, or Firm* — Jenkins, Wilson, Taylor & Hunt, P.A.

(57) ABSTRACT

A set of panels, especially floor panels, comprising panels with a first edge, a second edge opposite the first edge, and a third edge and a fourth edge opposite the third edge, wherein each edge has a supporting profile, suitable to forming with a supporting element of the opposite edge of a similar panel a connection between the panels, the supporting profile of the first edge or the supporting profile of the second edge having a locking element, which in a locking position serves for locking and in an installation position allows joining or separating of the supporting profiles along this direction, and in the laid state a first panel and a second panel form a row within a laying plane, while coupling is provided by which the locking element performs a blockable forced movement, and when forced movement is blocked the locking element is held in the locking position, and when not blocked the locking element can be moved from locking position if the supporting profiles are moved.

16 Claims, 5 Drawing Sheets

Figure 1:
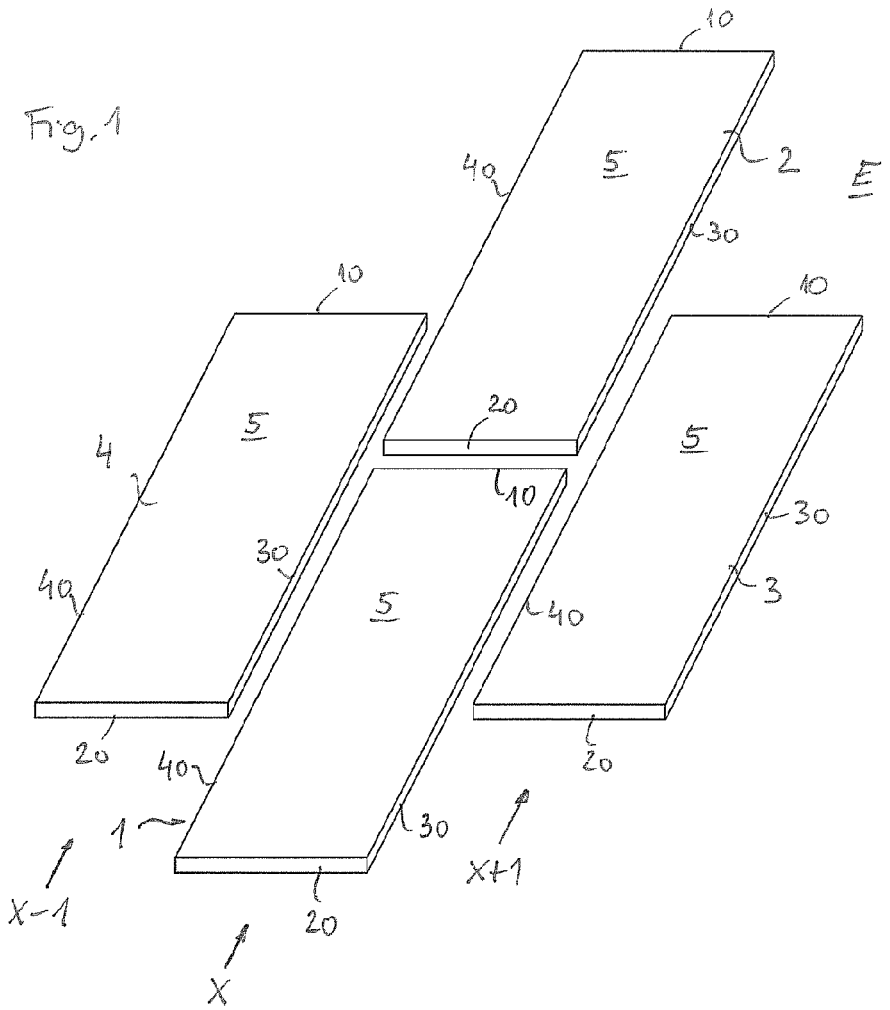

(52) U.S. Cl.
CPC ..... *E04F 2201/0523* (2013.01); *E04F 2201/0529* (2013.01); *E04F 2201/0535* (2013.01); *E04F 2201/0547* (2013.01)

(56) References Cited

U.S. PATENT DOCUMENTS

| | | | | |
|---|---|---|---|---|
| 7,980,039 | B2 * | 7/2011 | Groeke | E04F 15/02 403/350 |
| 8,381,476 | B2 * | 2/2013 | Hannig | 428/50 |
| 2007/0006543 | A1 * | 1/2007 | Engstrom | E04F 15/02 52/582.1 |
| 2008/0066415 | A1 * | 3/2008 | Pervan | E04F 15/02 52/588.1 |
| 2009/0064624 | A1 * | 3/2009 | Sokol | E04F 15/02 52/589.1 |
| 2009/0173032 | A1 * | 7/2009 | Prager | F16B 5/0044 52/588.1 |
| 2009/0308014 | A1 * | 12/2009 | Muehlebach | E04F 15/02 52/592.4 |
| 2010/0043333 | A1 * | 2/2010 | Hannig | E04F 15/02 52/582.2 |
| 2012/0124932 | A1 * | 5/2012 | Schulte | E04F 15/02 52/588.1 |
| 2013/0014463 | A1 * | 1/2013 | Pervan | E04F 15/02038 52/588.1 |
| 2013/0042562 | A1 * | 2/2013 | Pervan | E04F 15/02038 52/582.2 |
| 2013/0152500 | A1 * | 6/2013 | Engstrom | E04F 15/02038 52/588.1 |
| 2013/0263547 | A1 * | 10/2013 | Boo | E04F 15/02038 52/588.1 |
| 2015/0000221 | A1 * | 1/2015 | Boo | E04C 2/40 52/588.1 |
| 2015/0047284 | A1 * | 2/2015 | Cappelle | E04F 15/02 52/311.1 |

FOREIGN PATENT DOCUMENTS

| | | |
|---|---|---|
| WO | WO-97/47834 | 12/1997 |
| WO | WO-01/75247 | 10/2001 |
| WO | WO-03/016654 | 2/2003 |
| WO | WO-2008/004960 | 1/2008 |
| WO | WO-2011/061659 | 5/2011 |

* cited by examiner

Fig. 7
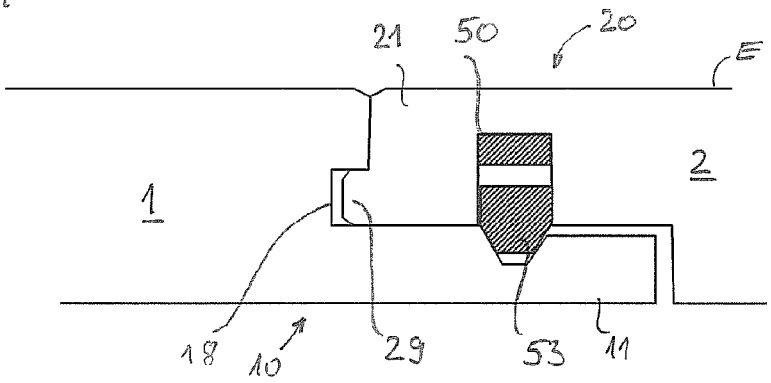
Fig. 8
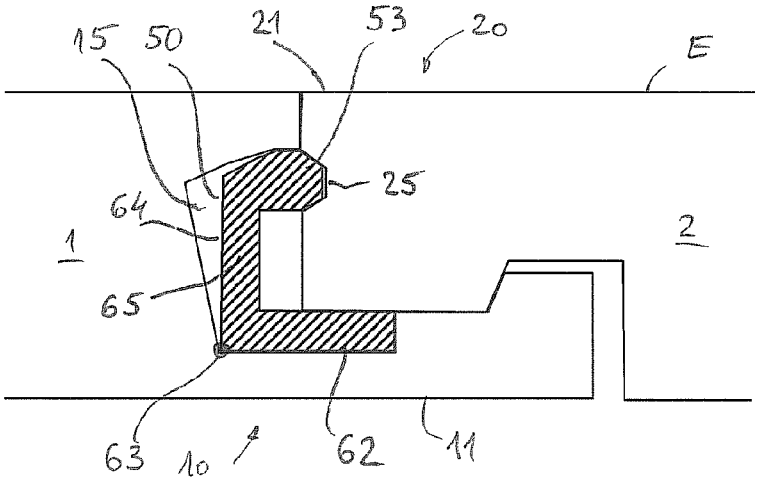
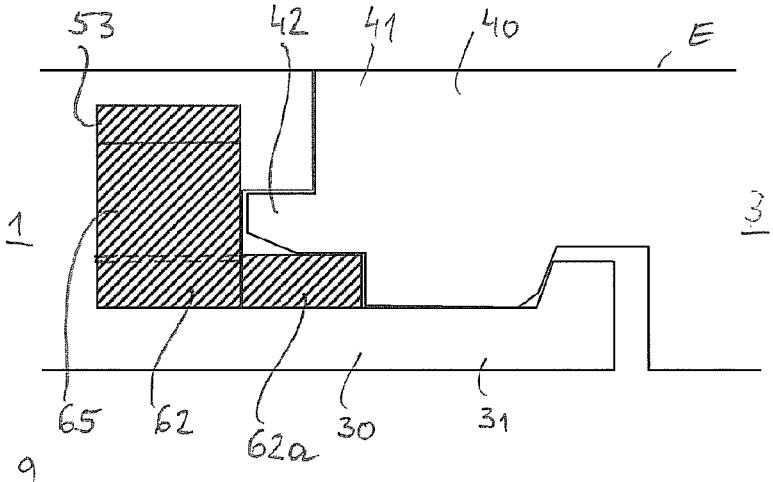
Fig. 9

SET OF PANELS WITH LOCKING ELEMENT

CROSS-REFERENCE TO RELATED APPLICATIONS

This application claims the benefit of and priority to European patent application No. 14 158 173.6 filed on Mar. 6, 2014, the entire disclosure of which is incorporated by reference herein.

The invention concerns a set of panels, especially one made from floor panels, wherein the set comprises panels which each have a first edge, a second edge, opposite the first edge, a third edge and a fourth edge, opposite the third edge. Each edge has a supporting profile which is suitable to forming with a supporting profile of the opposite edge of a similar panel a connection between these panels.

Rectangular floor panels are known from WO 94/26999 and WO 97/47834, having supporting profiles on their four edges, wherein a supporting profile on one edge of a floor panel and a supporting profile at the opposite edge of a similar floor panel in the joined state ensure a locking in the vertical direction (perpendicular to the laying plane) and a locking in the horizontal direction between these two panels. This makes possible a laying of these floor panels without glue.

Furthermore, rectangular floor panels with supporting profiles are known from WO 01/75247, wherein the supporting profiles on two opposite transverse edges (first and second edge) can be joined by a vertical relative movement, while the supporting profiles on the likewise opposite longitudinal sides (third and fourth edge) can be joined by a pivoting movement. This makes it possible, when laying the panels in rows, to join a panel by only a pivoting movement at the same time with an already laid panel of the same row at the transverse side and with an already laid panel or with already laid panels of a previous row at the longitudinal edge. These floor panels are also known as so-called fold-down floor panels. During the fold-down movement of the panel being installed, the supporting profile at its transverse edge is folded together with the supporting profile of the transverse edge of the already laid panel of the same row like the two blades of a scissors.

EP 1 415 056 discloses rectangular fold-down floor panels with two transverse edges and two longitudinal edges, wherein supporting profiles at the two transverse edges have a separate locking element. When joining the supporting profiles, the locking element is pressed into an installation position, by which the supporting profiles can be joined together via a vertical relative movement. The locking element then automatically locks into a locking position, in which the locking element provides a vertical locking of the two supporting profiles. A separation of these supporting profiles with locked locking element is not easily possible. While the possibility exists of separating the supporting profiles by a displacement in the lengthwise direction, this makes it difficult to de-install panels already laid in rows.

WO 2008/004960 discloses panels which can also be joined by a fold-down movement. Here as well, the supporting profiles have a separate locking element at the transverse edges, which provides a vertical locking. Starting from an installation position which makes possible a joining or separating of the supporting profiles by a vertical relative movement, however, the locking element does not automatically lock into a locking position when the supporting profiles of the transverse edges are joined together. The locking element is only pressed into the locking position when a following row of panels is installed. One panel of the following row exerts a sideways pressure (side push) on the locking element, so that it is shoved along the transverse edges and thus moved into its locking position. The side push by the panel of the following row in certain sample embodiments of WO 2008/004960 occurs against an elastic force, so that during a de-installation of the floor panels a restoring force again presses the locking element in the direction of the original installation position when the panel of the following row is de-installed. However, it is not ruled out that the locking element is jammed in the locking position, which prevents an easy separating of the supporting profiles at the transverse edges by a vertical relative movement.

WO 2011/061659 discloses panels with a locking element for the vertical locking of two supporting profiles, wherein at least one movable part of the locking element is moved along the supporting profiles when joining the supporting profiles. The locking element or at least the movable part of the locking element automatically locks into a locking position, by which the supporting profiles are locked in the vertical direction. An easy separation of such joined supporting profiles by a vertical relative movement is likewise not possible, due to the locked locking element.

An easy separating of joined supporting profiles is desirable not only during a de-installation of a laid floor, but it can also be very advantageous during the installation or laying as well, if a floor panel is supposed to be laid at first only as a trial. For example, in this way it is easy to check whether a cut-off floor panel which is supposed to form the last panel of a row also indeed has the correct length. A floor panel with a special design can also be laid as a trial in order to first test out its effect in conjunction with other floor panels already laid.

Therefore, the problem which the invention solves is to provide a set of panels which can be laid without glue, especially floor panels, whose handling is easy during the installation and de-installation.

The problem of the invention is solved with the combination of features according to claim 1. Sample embodiments of the invention will be found in the dependent claims.

According to claim 1, a panel has a first edge and a second edge opposite it. Furthermore, the panel has a third edge and a fourth edge opposite it. Each edge has a supporting profile, which is suitable to forming with a supporting element of the opposite edge of a similar panel a connection of neighboring panels. The supporting profile of the first edge or the supporting profile of the second edge has a locking element, which in a locking position serves for a locking in a direction transverse to the first edge and in an installation position allows a joining or separating of the supporting profiles along this direction. In the laid state, a first panel and a second panel form a row of panels within a laying plane, being joined together via the supporting profiles of the first and second edge. Coupling means are provided by which, during the movement of the locking element from the locking position to the installation position, at least one movable part of the locking element is forced to perform a movement or a forced movement, while the forced movement can be blocked. When this forced movement is blocked and therefore not possible, the locking element is held in the locking position. The locking element in the locking position provides for the locking in said direction transversely to the first edge. On the other hand, if the forced movement of the movable part is not blocked and thus is possible, the locking element can be moved from its locking position. Accordingly, in the latter case, the supporting profiles can be moved relative to each other in said direction and thus be separated.

The first panel and the second panel can be joined at the third edges with a third panel, forming another row of panels, while in the laid state of the third panel the forced movement of the movable part of the locking element is blocked and thus the locking element is held in the locking position. In the nonlocked state of the third panel, the locking element is moved from the locking position when the supporting profiles are moved relative to each other in said direction transverse to the first edge.

The forced movement of the movable part of the locking element can be a movement along the first edge or the second edge. The forced movement can also be a movement perpendicular to the laying plane or a movement parallel to the laying plane and transverse to the first or second edge.

Thus, a set of panels is disclosed, especially floor panels, whereby in the laid state the first panel and the second panel form a row of panels within the laying plane, being joined together at the first edge or the second edge, and they are joined to the third panel at the third edges, which forms another row of panels, while said coupling means are provided by which, during the movement of the locking element from the locking position to the installation position, at least the movable part of the locking element is moved along the first edge or second edge, while in the laid state of the third panel a movement of the movable part of the locking element along the edge is blocked and thus the locking element is held in the locking position, and whereby in the unlaid state of the third panel the locking element is moved from the locking position if the supporting profiles are moved relative to each other in said direction.

Preferably the panels are rectangular flooring panels. In what follows, the first and second edge shall also be called the short edges, while the third and fourth edge shall also be called the long edges. But it should be noted that the panels can also be nonquadratic panels, whose edges are equally long. It should also be noted that the first and second edge need not necessarily be shorter than the third and fourth edge. The following use of the terms "short edges" and "long edges" should therefore not be understood in a restrictive sense.

In the following, reference is made to panels which are used as floor panels, in order to cover a flat, horizontally extending subfloor with a flooring cover. Accordingly, the laying plane of the floor panels also extends horizontally, while a direction perpendicular to the laying plane constitutes a vertical direction.

The locking by the locking element can occur in a horizontal direction which, since we are assuming floor panels here, extends parallel to the laying plane. Preferably, the locking by the locking element occurs in the vertical direction, which extends perpendicular to the laying plane for floor panels. For sake of simplicity, in what follows we shall always make reference only to the locking in the vertical direction, but this shall also apply accordingly to a locking in the horizontal direction.

In concert with the third panel, which in the laid state does not allow the forced movement or movement of the movable part of the locking element in the lengthwise direction of the short edges, the locking element can provide for the preferred vertical locking. But if there is no limiting of the movement of the movable part along the short edge, the locking element cannot perform its locking action. Instead, it is automatically forced out from the locking position when a vertically acting force is applied to the first panel or the second panel in order to loosen the connection between the first panel and the second panel in the vertical direction. The function of the third panel, namely, the blocking of the forced movement of the movable part of the locking element, can basically also be taken over by another structural part.

The supporting profile of the first edge of the first panel can have an upward directed shoulder and the supporting profile of the second edge of the second panel can have a downward open groove, where groove and shoulder in the joined state of these supporting profiles ensure a locking in the horizontal direction transverse to the first edge. The shoulder can have a locking surface which is inclined relative to the laying plane by an angle (locking angle) between 60 and 90 degrees, preferably between 75 and 90 degrees. The locking surface can be level or also curved. A locking surface of the downward open groove, which can be formed by a side wall of the groove, can lie by its entire area against the locking surface of the shoulder when a force is acting which pulls apart the supporting profile of the first edge and the supporting profile of the second edge. Thus, the invention provides panels with large locking angles, which can be easily de-installed.

The vertical relative movement between the first panel and the second panel in order to join the supporting profile of the first edge of the first panel with the supporting profile of the second edge of the second panel can be a rectilinear movement. The supporting profiles can also be joined by a pivoting movement about an axis lying essentially in the laying plane and extending perpendicular to the first edge. The axis can essentially coincide with a third edge of an already laid panel of a preceding row, while the supporting profile of the fourth edge of the second panel can be joined by a pivoting or angling movement with the supporting profile of the third edge of the panel of the previous row. In this sample embodiment, the second panel can therefore be joined at two adjacent edges (second edge and fourth edge) by only one pivoting movement at the same time with a panel of the same row and with one or more panels of the previous row. Therefore, this involves the aforementioned fold-down movement.

The locking element can have a stationary part in addition to the movable part. For example, the stationary part can be fixed in a groove for the locking element in the lengthwise direction of the groove and also preferably transversely to the lengthwise direction of the groove. It is also possible for the locking element to move as a whole. It is also possible for the locking element to have a first movable part and a second movable part, where the first movable part can be moved relative to the second movable part. The locking element with the two movable parts can furthermore also have a stationary part.

In one sample embodiment, spring means are provided which constrain the movable part in the direction of a position such that the locking element assumes the locking position. The spring means can be part of the locking element, while the spring means exert a force on the movable part of the locking element so that the locking element is moved into the locking position or at least in the direction of this locking position.

The coupling means can have spring webs, which in the locking position of the locking element are inclined to the first edge or the second edge by an angle of 20 to 70 degrees (preferably 30 to 60 degrees). The spring webs can run parallel to the laying plane or be inclined by an angle of 0 to 90 degrees.

The coupling means can have guide surfaces along which the locking element or the movable part of the locking element slides when the locking element is moved from the locking position into the installation position. The guide surfaces can be formed by the stationary part of the locking element. It is also possible for the guide surfaces to be worked into the material of the floor panel. The floor panel can have a core of MDF, HDF or plastic, in which the guide surfaces and also additional grooves, shoulders, etc., can be worked.

In one sample embodiment, the locking element has a locking head, which has a slanting surface at a bottom side. The slanting surface can be level or curved. An angle between this slanting surface and the laying plane can be 20 to 70 degrees.

A locking groove to receive the locking head can have a lower groove wall, along which the slanting surface of the locking head slides so that the locking element is moved from its locking position when the joined supporting profiles of the short edges are supposed to be released by a relative movement of the panels. If the movement of the movable part of the locking element or the movement of the locking element lengthwise to the short edge is not blocked, the force for the releasing of the supporting profiles thanks to the slanting surface produces a movement of the movable part or the entire locking element, so that the locking element can leave the locking position.

The above sample embodiments with the slanting surface on the bottom side of the locking head and with the lower groove wall along which the slanting surface can slide involve panels in which the locking element is coordinated with the first edge. If the locking element is coordinated with the second edge, then the at least one slanting surface should be provided at a top side of the locking head, and then the slanting surface slides along an upper wall of the locking groove, preferably having the same inclination.

The movable part can be movably held between two side walls of a spring groove or sliding groove. The movable part can then have a width corresponding to the distance between the two side walls of the groove. In this case, there is no play between the movable part and the respective side wall of the sliding groove. Alternatively, a play can be provided, for example, less than 0.2 mm or preferably less than 0.15 mm.

In one sample embodiment, the first edge and the second edge have beveled top edges, which form a V-groove in the joined state of the first and second supporting profiles. As a result, any play between the upper fitting surfaces of the first edge and the second edge is less noticeable. Alternatively or additionally, the movable part of the locking element can press the supporting profiles together at the upper fitting surfaces. For example, the locking element can sit (partly) in a groove which is worked into the shoulder of the supporting profile of the first edge.

Figure 2:
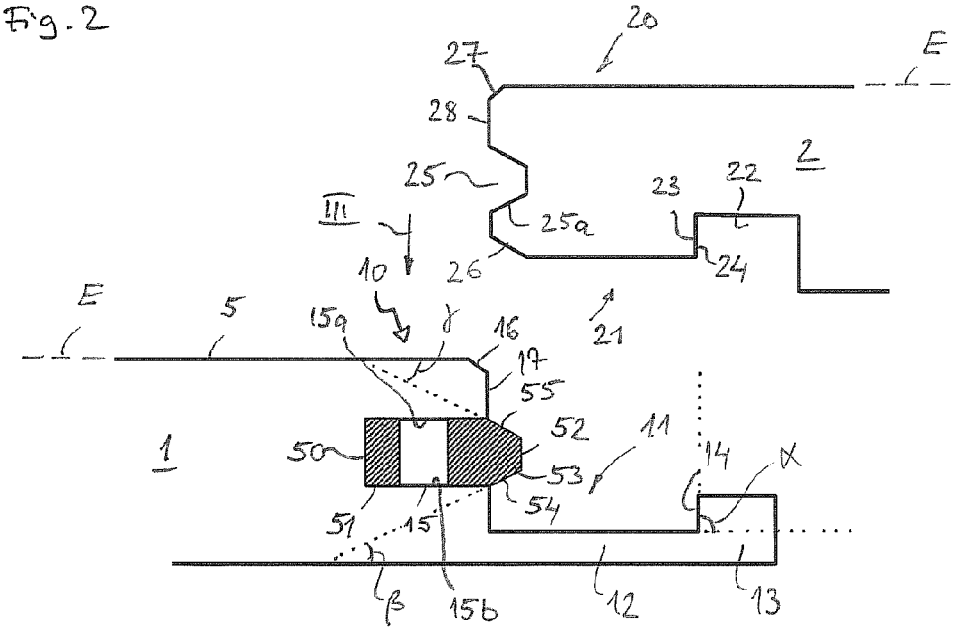
Figure 3:
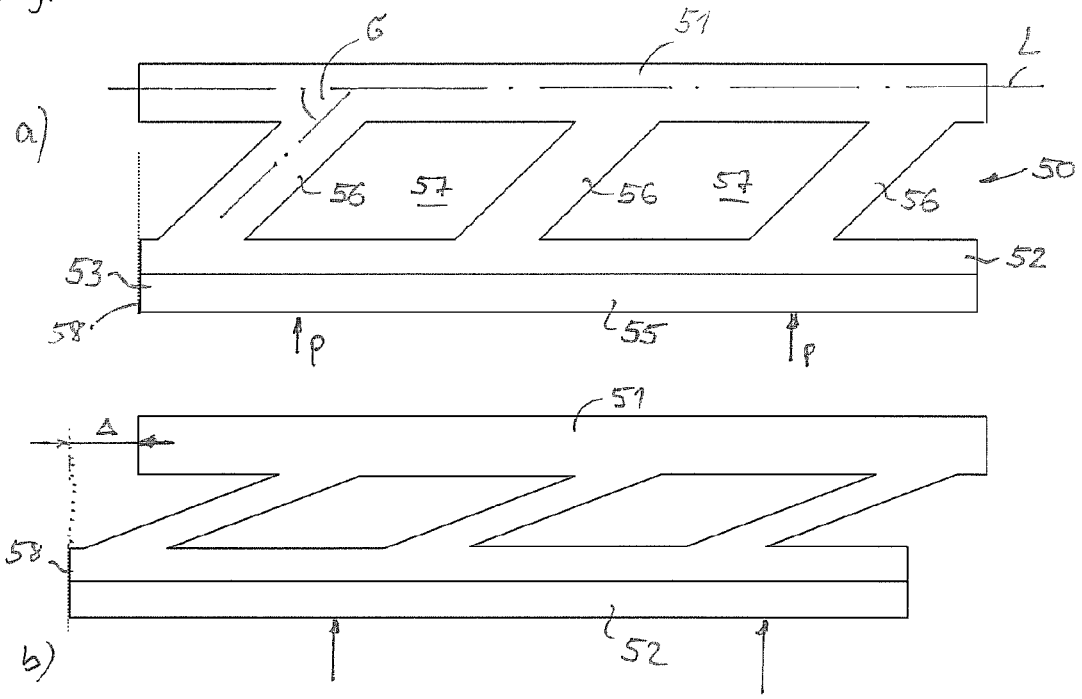
Figure 4:
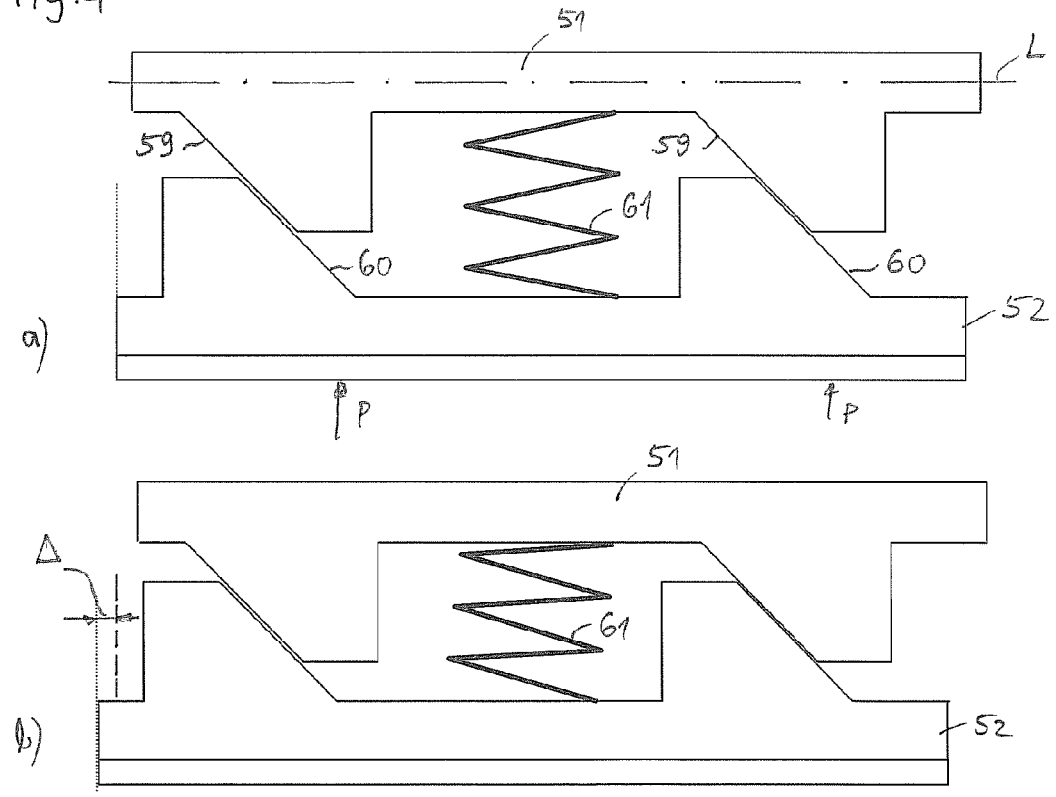
Figure 5:
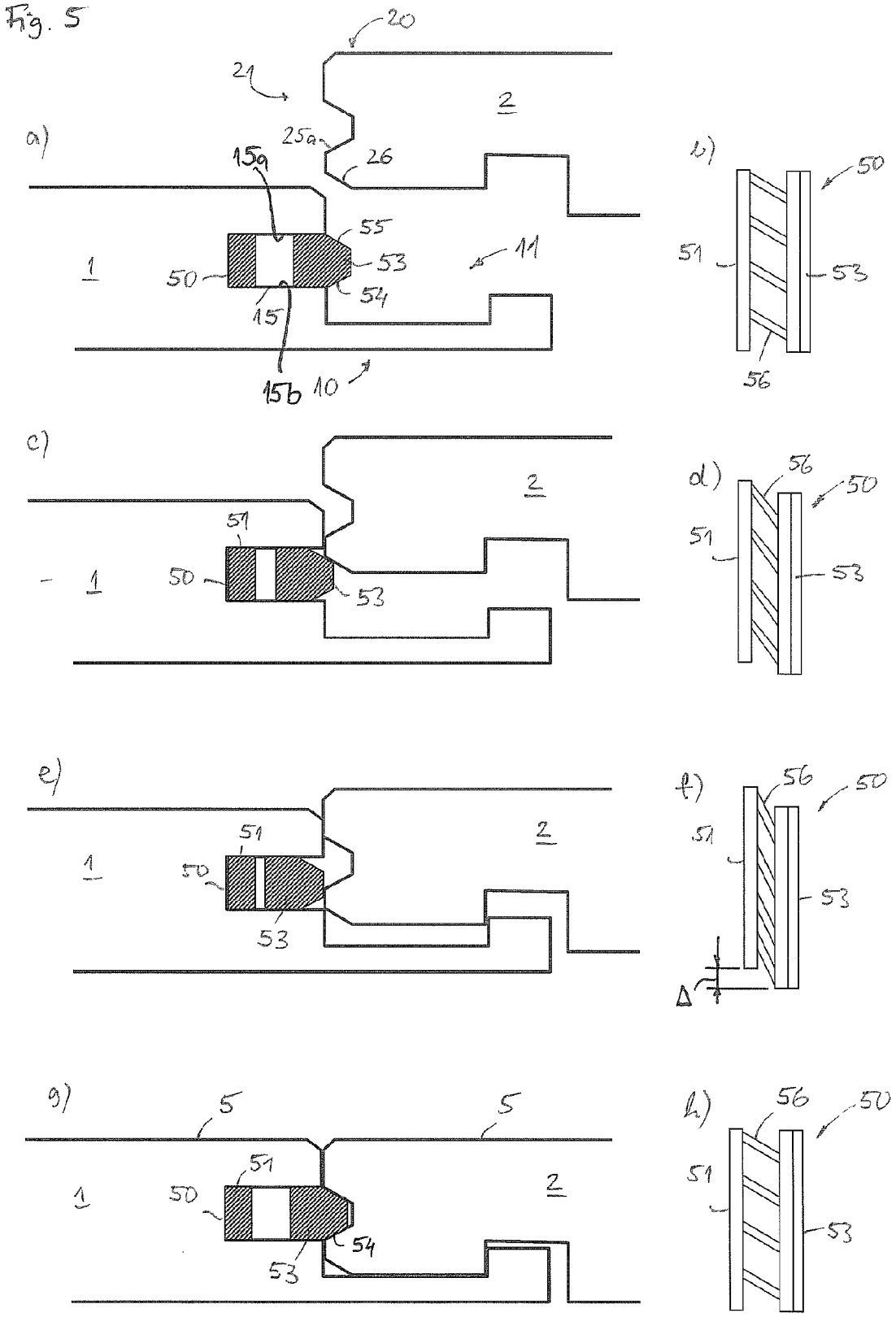
Figure 6:
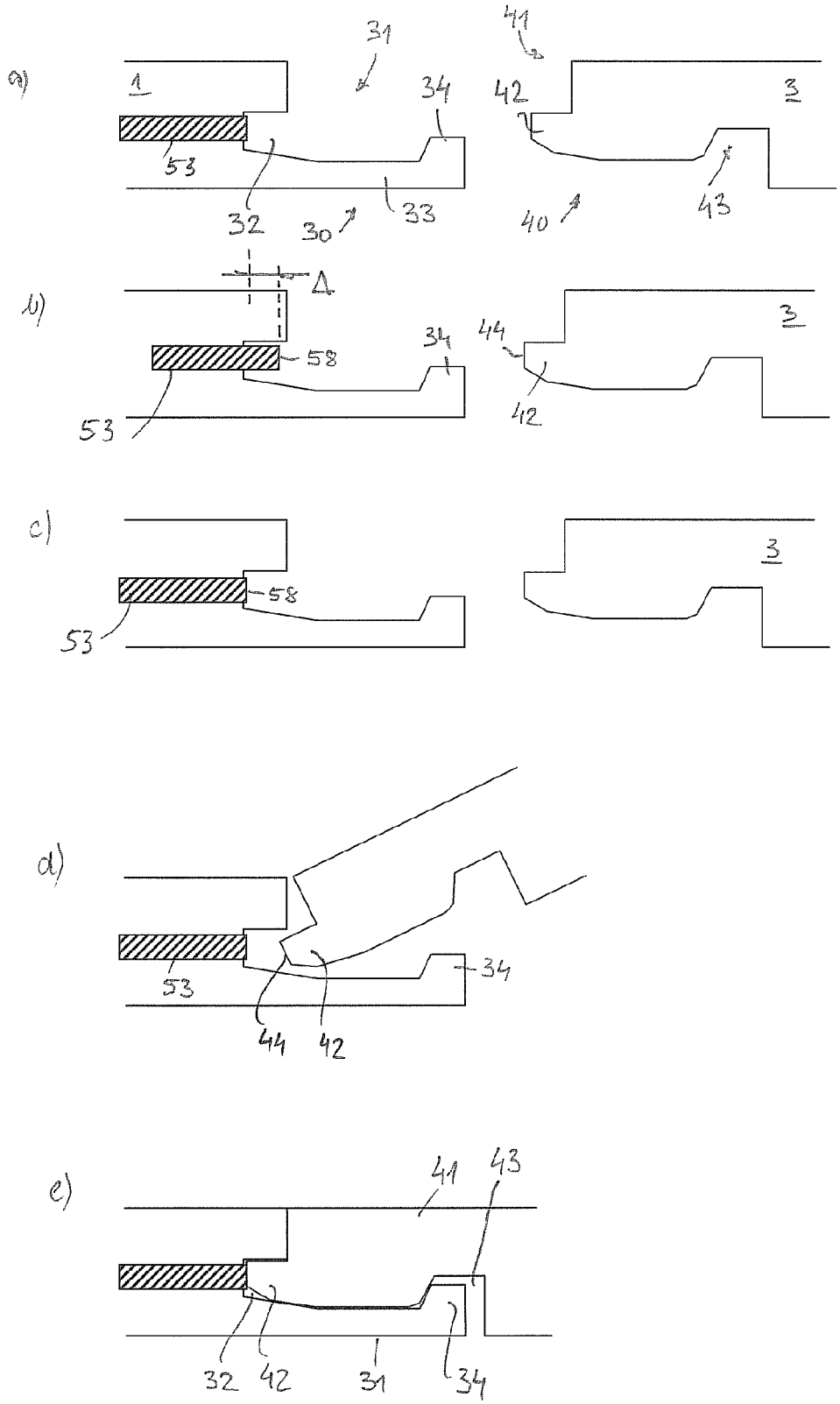

The invention will be explained more closely with the help of the sample embodiments shown in the drawing. There are shown:

FIG. 1 panels arranged in parallel rows;

FIG. 2 in cross section, a first edge of a panel and a second edge of another panel;

FIG. 3 a first sample embodiment of a locking element in a locking position and in an installation position;

FIG. 4 a second sample embodiment of the locking element in the locking position and the installation position;

FIG. 5 in cross section, the first edge and the second edge when these edges are joined together and a locking element in various positions;

FIG. 6 in cross section, a third edge and a fourth edge of a panel with different positions of the locking element;

FIG. 7 in cross section, the first edge and the second edge of another sample embodiment;

FIG. 8 in cross section, the first edge and the second edge of an additional sample embodiment; and FIG. 9 in cross section, the third and fourth edge of the sample embodiment of FIG. 8.

FIG. 1 shows in perspective representation a first panel 1 and a second panel 2, which are arranged in a row X. Furthermore, FIG. 1 shows a third panel 3 of a following row X+1 and a fourth panel 4, situated in a previous row X−1.

The panels 1 to 4 should be designed as floor panels and are identical in structure. Therefore, the more detailed description of the first panel 1 also applies accordingly for the other panels 2 to 4.

The first panel 1 is rectangular and has a top side 5, on which a decorative layer can be arranged. A first edge 10 and a second edge 20 form short edges on opposite sides of the rectangular panel 1. Furthermore, the first panel 1 has a third edge 30 and a fourth edge 40, forming the long edges at opposite sides. The short edges can be, for example, 10 to 40 cm long, while the long edges can be 80 to 200 cm long. A thickness of the panel 1 is preferably 4 to 12 mm. It is pointed out that the identical panels can have different decorative layers or different design motifs, which does not prevent them from being identical in configuration.

The first panel 1 has supporting profiles, but these are not shown in the representation of FIG. 1. The supporting profiles serve to join a panel with neighboring panels. For example, the first panel 1 can be joined at its fourth edge 40 with the third edge 30 of the fourth panel 4. For clarity, the panels 1 to 4 are shown at a spacing from each other in the representation of FIG. 1. In the laid state of the panels, i.e., with supporting profiles joined, the top sides 5 of the panels form a cohesive decorative surface, which should correspond to a laying plane E.

FIG. 2 shows, in cross section, the first edge 10 of the first panel 1 as well as the second edge 20 of the second panel 2. The first edge 10 has a supporting profile 11, comprising a web 12 and an adjoining shoulder 13. The shoulder 13 has a locking surface 14 perpendicular to the laying plane E. An angle $\alpha$ between the locking surface 14 and the laying plane E is accordingly 90 degrees. The angle $\alpha$ can also take on values different than 90 degrees (for example, in a range of 75 to 90 degrees).

A spring groove 15 with side walls parallel to the laying plane E (see upper side wall 15*a* and lower side wall 15*b* of the groove) serves to accommodate a separate locking element 50. The groove side walls 15*a*, 15*b* can also be inclined to the laying plane E. The locking element 50 has a stationary part 51 and a movable part 52. The movable part 52 is formed primarily by a locking head 53, having a slanting surface 54 on a bottom side. The slanting surface 54 is inclined to the laying plane E, while an angle $\beta$ between the slanting surface 54 and the laying plane E or a plane parallel to it is around 30 degrees in the sample embodiment shown here. Alternatively, the angle $\beta$ can also be less than (e.g., 20 to 30 degrees) or greater than this (e.g., 30 to 60 degrees). On a top side, the locking head 53 has another slanting surface 55, making an angle $\gamma$ with the laying plane. In the sample embodiment of FIG. 2, the angle $\gamma$ is roughly twice the magnitude of the angle $\beta$, but the angles $\beta$ and $\gamma$ can also be of different size. We shall discuss more closely below the connection between the stationary part 51 and the movable part 52 of the locking element 50.

The second edge 20 of the first panel 1 (in FIG. 2 the second edge 20 of the identical second panel 2 is shown) has a supporting profile 21, which can be joined by a relative vertical movement perpendicular to the laying plane E with the supporting profile 11. The supporting profile 21 comprises a downward open groove 22 with a side groove wall 23, defining a locking surface 24. In the joined state of the supporting profiles 11, 21, the locking surfaces 14, 24 should provide an interlocking of the supporting profiles in the horizontal direction transverse to the edges 10, 20 and parallel to the laying plane E.

The locking head 53 is accommodated in the supporting profile 21 by a locking groove 25, which has a lower groove wall 25*a*. Like the slanting surface 54 of the locking head 53, the lower groove wall 25*a* is inclined to the laying plane E. An angle of inclination between the lower groove wall 25*a* and the laying plane E preferably corresponds to the angle β between the slanting surface 54 and the laying plane E. A bevel 26 is provided below the locking groove 25.

The edges 10, 20 each have a beveled top edge 16 and 27, respectively, which form a V-groove in the decorative surface in the joined state of the supporting profiles 11, 21. The beveled top edges 16, 27 or the legs of the V-groove can be set off in color from the top side 5 of the panels 1, 2, so that they contribute noticeably to the overall design of the decorative surface. A fitting surface 17 extends between the beveled top edge 16 and the spring groove 15. In the joined state of the supporting profiles 11, 21, this fitting surface 17 is matched up with a corresponding fitting surface 28 above the locking groove 25. The connection of the supporting profiles 11, 21 can be designed so that the fitting surfaces 17, 28 abut against each other with a given pressing force. Alternatively, a small play can also be provided between the fitting surfaces 17, 28.

FIG. 3 (see FIG. 3*a*) shows a sample embodiment of the locking element 50. FIG. 3 shows the locking element from above, corresponding to a viewing direction along the arrow III in FIG. 2. Structural parts or features which are identical or similar to the structural parts and features of FIGS. 1 and 2 are given the same reference numbers. This also holds accordingly for all further figures.

Spring webs 56 are arranged between the stationary part 51 and the movable part 52 or the locking head 53 of the locking element 50. For example, the locking element 50 can be made by an extrusion process, while after the extrusion of the crude locking part is accomplished the spring webs 56 can be cut out in diamond shapes 57. Alternatively, the locking element 50 can also be an injection molded part.

FIG. 3*a* shows the locking element 50 in a locking position, while FIG. 3*b* shows the locking element 50 in an installation position. FIG. 2 also shows the locking element 50 in its locking position.

The spring webs 56 are inclined by an angle σ with respect to a longitudinal dimension L of the edge 10. In the sample embodiment of FIG. 3, this angle σ is around 45 degrees. Preferred values for the angle σ lie in a range of 30 to 60 degrees. The spring webs 56, the connection of the spring webs 56 with the stationary part 51 and/or the connection of the spring webs 56 with the movable part 52 are configured so that, when a pressure P is applied to the movable part 52, the spring webs 56 deviate to the side or move in a lateral direction (along the lengthwise dimension L) or become deformed. This has the result that the movable part due to the pressure P is moved not only in the direction of the stationary part 51, but also by a lateral deflection Δ along the lengthwise dimension L. The stationary part 51 and/or the edge 10 can have means (not shown) by which the stationary part 51 is fixed at least in the lengthwise dimension L relative to the edge 10.

FIG. 5 will be used to explain the relationship between the action of the locking element 50 and the lateral deflection Δ. FIG. 5*a* shows the supporting profiles 11, 21 in the non-joined state. The locking element 50 is in an unstressed starting position, which should correspond to the locking position. FIG. 5*b* shows the locking element 50 from above in the position corresponding to the position of the locking element 50 represented in FIG. 5*a*. Now, if the panel 2 is pressed down vertically in the direction of panel 1, the supporting profile 21 with the bevel 26 will come to bear against the slanting surface 55 of the locking element 50. Thanks to the inclination of the slanting surface 55 or the bevel 26, the locking head 53 will be pressed into the spring groove 15 (see FIG. 5*c*). FIG. 5*d*, which shows the locking element 50 in the position corresponding to FIG. 5*c*, makes it clear that the spring head 53 is displaced along the edge 10 in this process. The spring head 53 slides relative to the upper groove wall 15*a* and relative to the lower groove wall 15*b* in two direction transversely to the edge 10 and longitudinally to the edge 10.

FIG. 5*e* shows the locking element 50 in the installation position, in which the supporting profile 21 can be shoved entirely into the supporting profile 11. As compared to the position shown in FIG. 5*c*, the locking head 53 has not only moved further in the direction of the stationary part 51, but also further along the edge 11. When the supporting profile 21 has been pressed completely down, and the top sides 5 of the panels 1, 2 now lie in a common plane, the locking head 53 is pressed back into its original position thanks to the restoring forces of the elastically deformed spring webs 56. The locking element 50 is then once more in the locking position.

Thanks to the inclination of the slanting surface 54 and the lower groove wall 25*a* interacting with this slanting surface, however, the locking head 53 can be pressed back into the spring groove 15 if the supporting profiles 11, 21 are pulled apart in the vertical direction. Thus, without an additional design measure, the locking element could not produce an interlocking in the vertical direction. The supporting profile 21, starting from the position in FIG. 5*g*, could be moved upward relative to the supporting profile 11. Thus, it becomes clear that the term "locking position" here is not equivalent to a position in which the locking element necessarily produces an interlocking in the vertical direction.

The spring webs 56 are designed so that, starting from the locking position (see FIGS. 3*a* and 5*g*), a movement of the spring head 53 in the direction of the stationary part 51 necessarily results in a movement (forced movement) of the locking head 53 along the edge 10. If a movement of the locking head 53 along the edge 10 is not possible, neither can the locking head 53 be pressed into the spring groove 15. This, despite the inclined slanting surface 54 and the lower groove wall 25*a* inclined toward it, results in a locking of the supporting profiles 11, 21 in the vertical direction. Thus, the locking occurs not directly by the locking element 50 in concert with the locking groove 25, but only indirectly by the locking of the movable part 52 or the locking head 53 along the edge 10.

FIG. 6 makes clear how the lateral movement of the spring head 53 can be limited, so that starting from the position shown in FIG. 3*a* or in FIG. 5*g* a sideways deflection Δ is not possible. FIG. 6*a* shows a third edge 30 of the first panel 1 with a supporting profile 31. The supporting profile 31 can be joined with an essentially complementary supporting profile 41 at the fourth edge 40 of a third panel 3 (identical to panel 1) by an angling or a pivoting action, so that the supporting profiles 31, 41 provide both a horizontal locking (transverse to the edge 30) and a vertical locking. The supporting profile 31 has a groove 32, a web 33 as well as a shoulder 34. The groove 32 serves to accommodate a spring 42 of the supporting profile 41. In the joined state (see FIG. 6*e*), the spring 42 sits in the groove 32, so that the supporting profiles 31, 41 are locked in the vertical direction. The shoulder 34 engages in the joined state of the supporting profiles 31, 41 with a downward open groove 43, by which the supporting profiles 31, 41 are locked in the horizontal direction transversely to the edges 30, 40.

FIG. 6 shows not only the supporting profile 31 at the third edge of the first panel 1, but also the locking head 53 of the locking element 50 (schematically), which is inserted into the spring groove 15 of the first supporting profile 11. The position of the locking head 53 shown in FIG. 6*a* is meant to correspond with the starting position or the locking position of the locking element, as represented in FIGS. 5*a* and 5*g*. Now, if the panel 2 with the supporting profile 21 is pressed down, as shown in FIG. 5, in order to join it with the supporting profile 11 of the panel 1, the spring head 53 is displaced sideways (see especially FIG. 6*b* with the sideways deflection A).

The position of the locking head 53 shown in FIG. 6*c* corresponds to the locking position of the locking element 50 after the supporting profiles 11, 21 have been joined (see FIG. 5*g*). The locking head 53 is again returned fully back to its original position.

Now, to form the following row X+1, the third panel is set by its supporting profile 41 on a slant against the supporting profile 31 as shown in FIG. 6*d*, in order to pivot it downward from this slanted position. An axis for this pivoting movement runs parallel to the edge 30 and coincides to a good approximation with this edge 30.

In the joined state, one outer end 44 of the spring 42 lies directly against a lateral end 58 of the locking head 53. Thus, no movement of the locking head 53 along the edge 10 in the direction of the shoulder 34 is possible. In other words, the spring 42 thus blocks a lateral movement of the locking head 53 and, thus, its movement in the direction of the stationary part 51 of the locking element 50. Hence, the overall movement of the locking head 53 is blocked, so that the locking element 50 now provides a vertical locking of the supporting profiles 11, 21 at the edges 10, 20. On the other hand, if the third panel 3 is not installed or if the third panel 3 is removed, the second panel 2 can be easily folded upward, since in this case the movement of the spring head 53 is not restricted. Although a certain force might have to be exerted to overcome clamping forces in order to move the spring head 53, thanks to the inclination of the slanting surface 54 of the spring head 53 and the lower groove wall 25*a* of the locking groove 25 a force acting in the vertical direction is transformed directly into a force which presses the locking head 53 actively out of its locking position. Thus, an easy de-installation of panels laid in the horizontal direction and vertical direction is possible, by simply reversing the aforementioned series of steps taken during the installation.

FIG. 4 shows an alternative sample embodiment of the locking element 50. The stationary part 51 of the locking element 50 has guide surfaces 59, by means of which sliding surfaces 60 of the movable part 52 slide along them when the movable part 52 is subjected to a force P. As already explained above, the pressure P on the movable part 52 can be built up by a vertically acting force via the slanting surface 54. The interplay of guide surfaces 59 and sliding surfaces 60 ensures that the movable part 52 is shoved in the longitudinal direction L upon movement of the movable part 52 in the direction of the stationary part 51. Accordingly, here as well a sideways deflection Δ is produced (see FIG. 4*a*).

Between the stationary part 51 and the movable part 52 only spring means 61 are incorporated, which serve to press the movable part 52 from the installation position (see FIG. 4*b*) in the direction of the locking position (see FIG. 4*a*). The sample embodiment of FIG. 4 shows that the coupling means in the form of the guide surfaces 59, by which a sideways movement of the movable part 52 or the locking head 53 is produced, can be functionally separate from the spring means 61.

It should be pointed out that, as an alternative when joining the supporting profiles 31, 41 together, the springs 42 themselves can move the locking head 53 to the side by the amount of the sideways deflection Δ or a substantial portion thereof, so that only then does the locking element 50 takes up its locking position. Accordingly, the spring means 61 can also be omitted or designed otherwise.

FIG. 7 shows the first edge 10 of a panel 1 and the second edge 20 of a panel 2 for another sample embodiment. The supporting profiles 11, 21 of the edges 10, 20 can be joined here by a relative horizontal movement parallel to the laying plane E. A vertical locking is produced by a groove 18 with a spring 29 arranged therein. The locking element 50 here is coordinated with the second edge 20 and provides a horizontal locking transversely to the edges 10, 20, as long as the forced movement of the locking head 53 along the edges 10, 20 is blocked. Essentially, the locking elements of FIGS. 3 and 4 can be used here for the locking element 50. Also refer to the relationships of FIG. 5, which can be applied to the sample embodiment of FIG. 7.

FIG. 8 shows a sample embodiment for the first edge 10 and the second edge 20, in which the locking element 50 in the locking position shown here provides a vertical locking of the supporting profiles 11, 21 joined together. The locking element 50 has a locking head 53 and an activating leg, designated as 62. In the installation position, the locking element 50 is essentially tilted counterclockwise about an axis 63 as compared to the locking position shown in FIG. 8, so that the activating leg 62 points upward at a slant, and a rear wall 64 of a connection 65 between locking head 53 and activating leg 62 bears against the slightly inclined rear wall of the spring groove 15 or is essentially parallel with it. In the installation position, the locking head 53 is situated so far in the spring groove 15 that the panel 2 can be brought from above into the position shown in FIG. 8 by a vertical downward movement. In this process, the panel 2 pushes the upward slanting activating leg 62 downward, so that the locking element 50 is rotated clockwise about the axis 63 until the locking head 53 engages with the locking groove 25.

Along the edge 10, the activating leg 62 should have a certain protrusion at the end facing the third edge 30 relative to the locking head 53 and the connection 65 (see FIG. 9, in which the protruding region is designated as 62*a*). FIG. 9 shows the third edge 30 of the panel 1 of FIG. 8 as well as the fourth edge 40 of a third panel 3. As regards the basic layout of the supporting profiles 31, 41, refer to the sample embodiment of FIG. 6. In FIG. 9 one notices that the spring 42 is somewhat narrower in configuration, and it is arranged above the protruding region 62*a* of the activating leg 62. In the joined state of the supporting profiles 31, 41, the spring

42 thus presses on the protruding part 62*a* of the activating leg 62 and prevents the protruding part 62*a* from moving upward. The activating leg 62 or its protruding region 62*a* forms the movable part 52 of the locking element 50 here.

The locking element 50 of the sample embodiment represented in FIGS. 8 and 9 should be designed in terms of stiffness so that, owing to the fixed protruding part 62*a* of the activating leg 62, the locking element 50 is held in its locking position and thus the supporting profiles 11, 21 are locked in the vertical direction. The spring 42 or the third panel 3 here blocks the activating leg 62 in a direction perpendicular to the laying plane E, namely, vertically upward.

LIST OF REFERENCE SYMBOLS

1 first panel
2 second panel
3 third panel
4 fourth panel
5 top side
10 first edge
11 supporting profile
12 web
13 shoulder
14 locking surface
15 spring groove
15*a* upper side wall of groove
15*b* lower side wall of groove
16 beveled top edge
17 fitting surface
18 groove
20 second edge
21 supporting profile
22 groove
23 wall of groove
24 locking surface
25 locking groove
25*a* lower wall of groove
26 bevel
27 beveled top edge
28 fitting surface
29 spring
30 third edge
31 supporting profile
32 groove
33 web
34 shoulder
40 fourth edge
41 supporting profile
42 spring
43 groove
50 locking element
51 stationary part
52 movable part
53 locking head
54 slanting surface
55 slanting surface
56 spring web
57 cutout
58 side end
59 guide surfaces
60 sliding surface
61 spring means
62 activating leg
62*a* projecting part of activating leg 62
63 axis
64 rear wall
65 connection

The invention claimed is:

1. A set of panels comprising a first edge, a second edge opposite the first edge, a third edge, and a fourth edge opposite the third edge, wherein the first edge of a first panel comprises a supporting profile configured to form, with a supporting profile of a second edge of a second panel, a connection between the first and second panels, wherein the supporting profile of the first edge or the supporting profile of the second edge comprises a locking element which, in a locking position, is configured to lock the panels in a direction transverse to the first edge and, in an installation position, is configured to allow a joining movement or a separating movement of the supporting profiles of the first and second edges along the direction transverse to the first edge, wherein, in a laid state, the first panel and the second panel comprise a row within a laying plane, being joined together at the first edge and the second edge, respectively, wherein a coupling is configured to allow, during a movement of the locking element from the locking position to the installation position, at least one movable part of the locking element to perform a forced movement, wherein the forced movement can be blocked, wherein, when the forced movement of the movable part is blocked, the locking element is held in the locking position to prevent a separation of the panels and, when the forced movement of the movable part is not blocked, the locking element is movable from the locking position as the supporting profiles of the first and second edges, having been joined together, move relative to each other in the direction transverse to the first edge to separate the panels, wherein the third edge of the first panel and the third edge of the second panel are each respectively configured to be joined to a third panel, thereby forming another row of panels, wherein, in a laid state of the third panel, the third panel blocks the forced movement of the movable part of the locking element and the locking element is accordingly held in the locking position by the third panel, and wherein, in an unlaid state of the third panel, the locking element is movable from the locking position.

2. The set of panels according to claim 1, wherein the forced movement of the movable part of the locking element comprises a movement with respect to the first edge or the second edge.

3. The set of panels according to claim 1, wherein the direction is a horizontal direction extending parallel to the laying plane.

4. The set of panels according to claim 1, wherein the direction is a vertical direction extending perpendicular to the laying plane.

5. The set of panels according to claim 4, wherein the supporting profile of the first edge of the first panel comprises an upward directed shoulder and the supporting profile of the second edge of the second panel comprises a downward open groove which, in the joined state of the supporting profiles of the first and second edges, ensure a locking in a horizontal direction transverse to the first edge.

6. The set of panels according to claim 5, wherein the upward directed shoulder comprises a locking surface which is inclined relative to the laying plane by an angle between 75 and 90°.

7. The set of panels according to claim 1, wherein the supporting profile of the first edge of the first panel and the supporting profile of the second edge of the second panel are configured to be joined by a pivoting movement about an axis lying substantially in the laying plane and extending perpendicular to the first edge.

8. The set of panels according to claim 1, wherein the locking element comprises a stationary part which is separate from, but connectable to, the movable part.

9. The set of panels according to claim 8, wherein a spring is configured to constrain the movable part such that the locking element assumes the locking position.

10. The set of panels according to claim 1, wherein a spring is configured to constrain the movable part such that the locking element assumes the locking position.

11. The set of panels according to claim 1, wherein the coupling comprises spring webs which, in the locking position of the locking element, are inclined relative to the first edge or the second edge by 20 to 70°.

12. The set of panels according to claim 1, wherein the coupling comprises guide surfaces along which the movable part of the locking element is configured to slide when the locking element is moved from the locking position to the installation position.

13. The set of panels according to claim 1, wherein the locking element comprises a locking head which has a slanting surface at a bottom side and/or at a top side.

14. The set of panels according to claim 12, wherein a locking groove configured to receive the locking head comprises a lower groove wall or an upper groove wall, along which the slanting surface of the locking head is configured to slide when the locking element is moved from the locking position.

15. The set of panels according to claim 1, wherein the movable part is movably held between two side walls of a spring groove.

16. The set of panels according to claim 1, wherein the locking element comprises a stationary part, a spring element, and the movable part, wherein the stationary part is separated from and connected to the movable part by the spring element, and wherein all of the stationary part, all of the spring element, and at least part of the movable part are disposed within a spring groove of the first panel.

* * * * *